US009375073B2

(12) United States Patent
Orr, Jr. et al.

(10) Patent No.: US 9,375,073 B2
(45) Date of Patent: Jun. 28, 2016

(54) TABLET SUPPORT ACCESSORY

(71) Applicants: John Traylor Orr, Jr., Marietta, GA (US); Jack Robert Lander, Southbury, CT (US)

(72) Inventors: John Traylor Orr, Jr., Marietta, GA (US); Jack Robert Lander, Southbury, CT (US)

( * ) Notice: Subject to any disclaimer, the term of this patent is extended or adjusted under 35 U.S.C. 154(b) by 0 days.

(21) Appl. No.: 14/287,128

(22) Filed: May 26, 2014

(65) Prior Publication Data

US 2015/0335139 A1 Nov. 26, 2015

Related U.S. Application Data

(60) Provisional application No. 61/855,891, filed on May 28, 2013.

(51) Int. Cl.
*A45F 5/00* (2006.01)

(52) U.S. Cl.
CPC ..... *A45F 5/00* (2013.01); *A45F 2005/008* (2013.01); *A45F 2200/0525* (2013.01)

(58) Field of Classification Search
CPC ..... A45F 5/00; A45F 2200/0525; A45F 3/14; A45F 2005/008; A45C 2011/003; A47B 23/002
USPC ..... 224/219, 222, 271, 270, 257, 258; 108/43
See application file for complete search history.

(56) References Cited

U.S. PATENT DOCUMENTS 2,888,705 A * 6/1959 Bray ..... A47L 23/18 12/120.5
3,215,453 A * 11/1965 Malcom, Jr. ..... A45F 5/00 108/43
5,615,817 A * 4/1997 Shevers, Jr. ..... A45F 5/00 108/43
5,667,114 A * 9/1997 Bourque ..... A45F 5/00 224/257
5,927,210 A * 7/1999 Hacker ..... A47B 23/002 108/43
6,520,394 B2 * 2/2003 Ulibarri ..... B42D 5/005 108/43
7,051,910 B2 * 5/2006 Sprague ..... A45C 13/30 224/262
7,780,049 B1 * 8/2010 Baranoski ..... A45F 3/14 211/117
8,109,421 B2 * 2/2012 McLean ..... A45C 11/00 190/100
8,807,406 B1 * 8/2014 Thach ..... A45F 5/00 224/153
2004/0256433 A1 * 12/2004 Baird ..... A45F 5/02 224/666
2007/0017945 A1 * 1/2007 Willis ..... A45F 3/14 224/270
2007/0051766 A1 * 3/2007 Spencer ..... A45C 11/00 224/607
2007/0221696 A1 * 9/2007 Kakita ..... A45F 3/02 224/581
2009/0229497 A1 * 9/2009 Persico ..... A47B 23/002 108/43
2012/0152990 A1 * 6/2012 Kulas ..... A45F 5/00 224/222
2012/0246879 A1 * 10/2012 Pestal ..... A47B 23/002 24/3.2
2012/0325995 A1 * 12/2012 Balestrino ..... F16M 13/04 248/274.1

* cited by examiner

*Primary Examiner* — Corey Skurdal

(57) ABSTRACT

A tablet support accessory is revealed that holds electronic tablets, iPads, notebooks, game players, e-readers, smartphones, or other interactive electronic devices or viewing devices, on the thigh of a sitting, supine, or semi-supine person. Because interactivity at times involves the tapping on the face of the device, the tablet support accessory is stabilized by coupling a thigh brace and platform assembly, on which the device is held, to a support in the wearer's knee-shin region by means of an adjustable strap.

6 Claims, 8 Drawing Sheets

TABLET SUPPORT ACCESSORY

This application follows a Provisional application filed on or about May 27, 2013, the application number of which cannot be located.

FIELD OF THE INVENTION

The technology described herein relates generally to a device for supporting portable electronic devices, such as electronic tablets, iPads, notebooks, game players, e-readers, smart-phones, and the like on a person's leg for user interaction with the device. In particular this technology relates to a sling type assembly that mounts on the user's thigh, and across his or her knee, to a support in the knee-shin region for the user's interaction with an electronic tablet and the like.

BACKGROUND OF THE INVENTION

A tablet computer, generally called a tablet, is a mobile computer, larger than a mobile phone or personal digital assistant, integrated into a flat touchscreen, primarily interactively operated by touching the screen rather than using a physical keyboard and mouse Users generally have access to an on-screen virtual keyboard.

Early examples of the tablet concept originated in the 20th and 21st centuries mainly as prototypes and concept ideas; prominently, Alan Kay's Dynabook of 1968. The first commercial portable electronic devices based on Kay's concept, appeared at the end of the 20th century During the 2000s, Microsoft attempted a relatively unsuccessful product line with the Microsoft tablet PC, which carved a niche market at hospitals and outdoor businesses. In 2010, Apple released the iPad, which used touch-screen technology similar to that used in their iPhone, and became the first mobile computer tablet to achieve worldwide commercial success.

Besides having many personal computer capabilities, popular tablet computers purchased around 2012 and forward include wireless Internet browsing functions, potential cell phone functions, GPS navigation, and video-camera functions. These devices weigh around 2 or 3 pounds and typically have a battery life of up to 10 hours.

A key and common feature among tablet computers is touch input. This allows the user to navigate easily and intuitively, and type with a virtual keyboard on the screen.

The tablet computer's operating system responds to touches on the screen, rather than clicks of a keyboard or mouse, which allows integrated hand-eye operation, a natural part of the somatosensory system.

Because tablets, by design, are mobile computers, wireless connections are less restrictive to motion than wired connections. Wi-Fi connectivity has become ubiquitous among tablets. Bluetooth, a wireless communication method, is commonly used for connecting peripherals and communicating with local devices in place of a wired USB connection.

The advantages and disadvantages of tablet computers are highly subjective measures. What appeals to one user may be exactly what disappoints another. The following are commonly cited opinions of tablet computers versus laptops:

a. Advantages
   i. Usage in environments not conducive to a keyboard and mouse, such as lying in bed, standing, or handling with a single hand,
   ii. Lighter weight,
   iii. Touch environment makes navigation easier than conventional use of keyboard and mouse or touchpad in certain contexts, such as image manipulation, musical, or mouse oriented games, and for people with certain disabilities,
   iv. Digital painting and image editing are more precise and intuitive than painting and sketching with the mouse,
   v. The ability for easier or faster entry of diagrams, mathematical notations, and symbols,
   vi. Allows, with the proper software, universal input, independent from different keyboard localizations,
   vii. Some users find it more direct and pleasant to use a finger to point and tap on objects, rather than use a mouse or touchpad,
   viii. Longer battery life than laptops or netbooks.
b. Disadvantages
   i. Higher price,
   ii. Slower input speed, Due to higher speeds and capacities, tablets are increasingly being used for reading and entertainment, especially movies. With increasing frequency, users are in bed or lounging while watching movies, reading or surfing the Internet, using their tablets, both at home and when traveling. While there is a plethora of tablet accessories, none facilitates the bed mode or the lounging mode of using a tablet with an easily transportable compact device.

Currently, there is no comfortable position for using a tablet or eReader in a reclining or semi-reclining position for more than a few minutes. Watching a movie or reading a book for two hours becomes very tiring, especially for the user's wrists and arms. Users currently have several options. They can:

a. hold the device up in the air with one or both hands;
b. rest the device in their lap and against their thighs;
c. set the device in an easel on their stomach;
d. lay sideways in bed, and rest the device on the mattress, holding it upright with one hand.

None of these options is satisfactory.

Option 'a.' tires the hands and arms after a few minutes, plus the beveled edge of the device tends to dig into the palms of the hands. Additionally, this option does not leave both hands free to type data input, eat snacks, or reply to a text message on a smartphone.

Option 'b'. and 'c'. leave the hands free, but do not provide a comfortable viewing position. The head has to lock downward at an uncomfortably sharp angle, with the chin almost touching the chest, plus it is difficult to keep the device level on a curved and moving stomach.

Option 'd'., while providing a fairly comfortable position, does not leave both hands free, and does not allow for any practical multitasking. Additionally, option 'd'. requires viewing the screen at a disorienting angle.

Moving to a seated-upright position exasperates the user due to his head being locked in an extreme downward angle since the device is positioned in his lap.

Sitting at a desk or table with the device in a case easel provides a good viewing angle and permits hands free operations, but watching a movie seated upright is not very relaxing, plus the desk does not provide portability.

In an attempt to provide solutions to the above problems, lap desks combined with a pillow, build-in easel stands, briefcase bases with tilted easels have been tried. Floor-standing poles equipped with long arms and straps are also being used.

Related patents and published patent applications known in the background art include the following:

U.S. Pat. No. 4,264,049, issued to Daniels on Apr. 28, 1981, discloses an easel which includes a drawing board equipped with flexible straps for stabilizing and supporting the drawing board in different positions with respect to a person's body; such as, for instance, depending upon whether the person is in a standing or reclined position. A first adjustable length strap is adjustably secured at both ends to respective opposite lateral sides of the board toward the rear portion of the board and is adapted to pass around the person's neck or back. A second strap is adjustably attached to and can extend downwardly either from the front portion of the board in order to pass around the person's foot, or it can be partially draped over the top surface of the board and downwardly over the rear edge of the board so that both ends of the strap pass under the person's foot for additional stability.

U.S. Pat. No. 5,186,375, issued to Plonk on Feb. 16, 1993, discloses a body supported combination holder and writing surface for use with hand held computers used in the field of utility meter reading provides for the retention of such a computer within a channel of the holder. The computer is retained within the channel by channel extensions which extend slightly over the edges of the computer, and by retaining clips within the bottom of the channel. The keyboard of the computer is fully accessible through the open upper side of the channel, and the writing surface is essentially coplanar with the keyboard of the computer when such a computer is installed within the holder. The membrane keyboard typical of such computers permits the writing surface to extend across the relatively narrow face of the computer in order to provide a larger writing surface area. The holder may be supported by retaining pins inserted within holes provided in the device, or in an alternate version by an extension insertable within the trouser waistband of the user, thus leaving both of the user's hands free. One or more storage compartments may be included by enclosing the space immediately below the writing surface. Relatively minor modifications of the holder permit its use with a variety of similarly configured electronic devices.

U.S. Pat. No. 5,263,423, issued to Anderson on Nov. 23, 1993, discloses a securement device for releasable attachment of a laptop computer or other article to a user's leg includes a table member and a pair of in-folding leg members, one each of which is attached for hinged movement relative to a corresponding side edge portion of the table member. Elastic webbing interconnects the free end portion of each leg member to a central portion on the underside of the table member. The securement device is centered on a user's leg and a pair of co-acting straps are used to snugly encircle the user's leg to prevent pivotal movement of the securement device relative thereto and the leg members brace the table member to prevent displacement thereof as a result of ordinary unbalanced imposed forces. Elastic straps are provided whereby an article such as a laptop computer may be releasably attached to the supporting surface of the table member. The securement device allows a user of a laptop computer to stand and walk a few steps without displacing the laptop computer. When removed from a user's leg, the securement device folds to a compact storage position.

U.S. Pat. No. 5,667,114, issued to Bourque on Sep. 16, 1997, discloses a laptop-computer carrying apparatus that includes a platform for supporting a laptop computer. The apparatus also includes a pair of supporting members, each connected to one side of the platform. A carrying strap is connected between the supporting members, and may be looped around a computer user's neck or shoulders to support the platform at approximately waist level. The user may then use the platform as a work surface upon which the laptop computer may be securely fastened.

U.S. Pat. No. 5,724,225, issued to Hrusoff et al. on Mar. 3, 1998, discloses a supporting device for a laptop type model computer unit. The device is constructed and arranged for the support and stabilization of the laptop computer or notebook type computer unit when directly positioned in front of, or before, the user in order to permit the maximum amount of stability and thus allowing the operator to freely stand, sit, walk, carry, or move about with the computer unit intact when in an upright position with little or no stress. The instrument, when in its operational position, has an over the shoulder or over the neck strap, connecting the central computer carrying tray directly before or perpendicular to the user's body. Because the instrument is arranged perpendicularly to the body, the user has the maximum stability of the entire computer unit and access to its operational surface.

U.S. Pat. No. 5,937,765, issued to Stirling on Aug. 17, 1999, discloses a leg-worn support assembly for a laptop computer. There is a substantially planar, rigid platform for attachment to the computer, and first and second tensioned leg straps which depend from the edges of the platform for extending around the user's leg. A pad is mounted on the lower surface of the platform and has a channel area therein for engaging the upper edge of the leg. Non-slip surfaces are formed on both the leg straps and the channel area for frictionally engaging the leg so as to provide a stable work platform.

U.S. Pat. No. 5,938,096, issued to Sauer et al. on Aug. 17, 1999, discloses a laptop computer support system, for supporting a laptop computer upon a person, so that the laptop computer may be operated while the person is standing, comprising a lower casing and a cover. The lower casing comprises a lower casing front, two side panels, and a lower casing rear. The cover is hingeably attached to the lower casing at the lower casing rear. A waist strap is attached to the side panels near the lower casing front. A neck strap is attached to the side panels near the lower casing rear. The laptop computer has a keyboard portion and a display portion. The lower casing has a keyboard shield which protects the keyboard from moisture. The display is situated between the display shield and the cover. When the cover of the laptop support system is opened, the display is brought into an upright position.

U.S. Pat. No. 6,006,970, issued to Piatt on Dec. 28, 1999, discloses a laptop computer harness having a left shoulder strap for providing for the support in front of a standing user of a left side of a laptop computer. An upper part of a single belt is attached at a point near a left rear corner of the laptop computer, then passes over the left shoulder and then under the left arm of the user, and with an attachment to attach a lower part of the strap to a left front corner of the laptop computer. A right shoulder strap for providing for the support in front of the user of a right side of the laptop computer. An upper part of a single belt is attached at a point near a right rear corner of the laptop computer, then passes over the right shoulder and then under the right arm of the user, and with an attachment to attach a lower part of the strap to a right front corner of the laptop computer. A chest webbing for gathering the left shoulder strap to the right shoulder strap along a transverse line in front of the user's neck near the user's chest area. A back webbing for gathering the left shoulder strap to the right shoulder strap along a transverse line in back of the user's neck near the user's shoulder-blade area. A rear clamp assembly for mechanically securing the upper parts of the left and right shoulder straps to the left-rear and right-rear corners of the laptop computer. A front clamp assembly for mechanically securing the lower parts of the left and right shoulder straps to the left-front and right-front corners of the laptop computer. A tensioner for drawing the the laptop computer taut between the front and rear clamp assemblies.

U.S. Pat. No. 6,106,016, issued to Bette on Aug. 22, 2000, discloses a chest mounted book holder for carrying a field guide or other reading matter while hiking or observing nature attached to the chest area of an outer garment or to an adjustable upper body harness. The book holder includes page holders for holding the book open at a desired page and protects the pages from turning in the wind and is equipped with side stops so the book cannot fall out. Adjusting straps allow the book to be positioned at a comfortable distance and angle from the reader and can be folded and secured against the chest when not in use. The user is able to turn the pages of a book when the book holder is in an open position and to make notes on the book or adjacent to it.

U.S. Pat. No. 6,381,127, issued to Maddali et al. on Apr. 30, 2002, discloses a laptop computer support having a generally planar support base with shoulder straps attached to a leading edge of the support base and back straps attached to a trailing edge of the support base. The shoulder and back straps converge at a strap junction overlaying the user's back when the computer support is in use. The laptop computer support affords virtually unrestricted access to at least three sides of the laptop computer base wherein hardware/software ports are conventionally located, and the shoulder and back straps are advantageously configured so as to distribute the weight of a laptop computer evenly across the user's shoulders and back. The laptop computer is variably fixed to the support base with a hook and loop type fastener.

U.S. Pat. No. 6,663,072, issued to Ritchey et al. on Dec. 16, 2003, discloses a lap stabilization device includes a support tray, and at least one strap which is routed around and removably secured to the legs of a seated person to provide a stabilized work surface. The stabilized work surface can be used to secure a laptop computer, or any other object which requires stabilization on the lap of the person. In the first embodiment, the lap stabilization device comprises the support tray and at least one strap. In the second embodiment, the lap stabilization device can further include a lid thereby providing storage capacity for a laptop computer in the form of a laptop computer carrying case. Various structures are disclosed for attaching the stabilization device to the lap of the user. A refracting mechanism can be used to store and to selectively feed a desired length of securing strap for securing the stabilization device to the lap of the user.

U.S. Pat. No. 7,051,910, issued to Sprague et al. on May 30, 2006, discloses a field desk apparatus, designed to be worn by a user, is configured with two soft triangular structures having a work platform as a common element. Shoulder straps and support straps for the remaining two elements for each of the soft triangular structures, respectively. The weight of a work piece, supported by the work platform, is distributed to a lateral belt of the field desk apparatus, via the soft triangular structures, to ergonomically balance the weight of the work piece about the user.

U.S. Pat. No. 7,780,049, issued to Baranoski on Aug. 24, 2010, discloses an easy to use notebook computer support system which will fit virtually any notebook or laptop computer. It has comfortable shoulder pads and allows access to all ports (front, back and side). In particular, it allows access data ports, power ports as well as disk drives. Significantly, the system according to the invention comprises only straps and little strap hardware so that it can fold up and fit into any type of laptop carrying case. Unlike other supports, the present invention does not block the ventilation fan(s) on the bottom of the computer.

U.S. Published Patent Application 2007/0089646, inventor Duncan, published on Apr. 26, 2007, discloses a lap support system in which a support includes a first fastener. A leg strap can be releasably secured to a user's thigh with a second fastener configured to releasable engage the first fastener and thereby attach the support to the user. The leg strap can be mounted to the thigh and the support can be operably and selectively attached and detached to and from the leg strap without requiring coincidental attachment and detachment of the leg strap to and from the thigh.

U.S. Published Patent Application 2007/0221696, inventor Kakita, published on Sep. 27, 2007, discloses a carrying case for enclosing an electronic device for use by a user. The carrying case includes a compartment flap and a cover flap that is hingedly coupled to the compartment flap. The carrying case further includes a device retainer attached to the cover flap to retain the electronic device. The carrying case further includes a foot strap attached to the compartment flap. The foot strap includes a loop portion positionable about a foot of the user for retaining the electronic device upon an upper leg of the user when in a backward lying position.

U.S. Published Patent Application 2009/00229497, inventor Persico et al., published on Sep. 17, 2009, discloses an apparatus for securing a laptop computer to a user's leg which includes a base having apertures on opposing lateral sidewalls. A frictional material is applied to a top and bottom surface of the base for limiting slip between the base, the laptop computer and the user's leg. A first strap includes a first buckle and a surface having a self-attachment means where the first strap is inserted in one of the apertures with the first buckle above the top surface. A second strap includes a second buckle and a surface including a self-attachment means where the second strap is inserted in another of the apertures on the opposing sidewall with the second buckle below the bottom surface, the second strap is passed through the first buckle for securing the laptop computer and the first strap is passed through the second buckle for securing to the user's leg.

U.S. Published Patent Application 2010/0294908, inventor Mish et al., published on Nov. 25, 2010, discloses a bookstand for an eReader including a center support and a plurality of manipulatable supports coupled to the center support. The plurality of manipulable supports being moveable between at least a first storage position and a second open position for supporting the eReader in a reading position.

U.S. Published Patent Application 2012/0018609, inventor Rowzee et al., discloses a supporting apparatus for a thin electronic product is composed of a main body having a chamber, a plurality of fillers received in the chamber, an external lateral surface, and a locating portion located on the external lateral surface. The thin electronic product can be visibly fastened to the external lateral surface by the locating portion. Because the supporting apparatus can be firmly put on a surface and define a predetermined angle with respect to the surface, while the thin electronic product is fixed to the external lateral surface of the main body, the thin electronic product can define the predetermined angle with respect to the surface to allow the user to conveniently operate the thin electronic product.

Thus, a compact portable device that facilitates engaging a tablet while in bed or lounging is desired.

The foregoing patent, published patent application, and non-patent information, reflect the state of the art of which the inventor is aware and is tendered with a view toward discharging the inventor's acknowledged duty of candor in disclosing information that may be pertinent to the patentability of the technology described herein. It is respectfully stipulated, however, that the foregoing patent and other information do not teach or render obvious, singly or when considered in combination, the inventor's claimed invention.

BRIEF SUMMARY OF THE INVENTION

The technology described herein pertains to devices configured for holding tablets and the like.

In an exemplary embodiment the technology is directed to an assembly configured to hold a tablet while sitting or reclining, or semi-reclining, that is, lying in bed, sitting in a recliner, sitting against a tree on college grounds, and so on.

In an illustrative example a tablet support accessory, also known as Kneasy™, is comprised of a compressible pad assembly that is configured to hang on the outer side of a raised leg in the knee-shin region. A compressible pad assembly comprises a compressible pad, an arch-shaped plastic backing strip and a leather cover. The compressible pad is enclosed in the cover. The inner and outer parts of the cover are leather, with the suede side against the shin-knee region, and the smooth side facing outward away from the shin-knee region.

Also contained in the cover is an arch-shaped plastic backing strip, one inch wide, having rounded ends that protrude an inch from each end of the cover, said ends having pivot holes to receive eyelets. The arch-shaped plastic backing strip acts to compress and comfortably conform the pad to the wearer's knee-shin region when tension is applied to its protruding ends.

Straps three-quarters of an inch wide, and 8 inches long, are pivotally attached to the protruding ends of the arch-shaped backing strip.

The suede part of the compressible cover, that is, the side touching the knee-shin region, acts as a relatively nonslip surface.

The tablet support accessory is further comprised of a platform assembly which comprises an arch-shaped brace configured to fit the users thigh, and a planar platform against which the tablet rests.

The surface of the arch-shaped brace that is in contact with the thigh is lined with thin nonslip rubber.

The surface of the planar platform that is in contact with the tablet is lined with thin nonslip rubber.

Extending at a right angle from the lower part of the planar platform is a first lip that acts as the support on which the lower end of the tablet rests. Extending from the first lip is a second lip, disposed upward at substantially a right angle to the first lip, which prevents the bottom edge of the tablet from slipping toward the user, and falling off the platform.

The first lip and second lips are lined with thin nonslip rubber, and the first lip lining is configured with a tier 3/32 inch high, longitudinally occupying about half the width of the channel formed by the platform, first lip, and second lip. The tier is disposed toward the second lip. The tier serves to hold a relatively thin tablet substantially parallel with the platform by preventing its bottom edge from slipping toward the second lip, thus providing a snug fit at its bottom edge, and yet allowing enough longitudinal width in the channel to accommodate a relatively wide device such as a GPS.

The thigh brace has a pivot hole at its left and its right sides close to the side edges and the top edge.

Identical slide-buckle strap assemblies, 3 inches long overall, are pivotally attached with eyelets through each thigh brace pivot hole. The distal end of each slide-buckle strap terminates with a slide-buckle of the cam-action type.

The 8 inch straps pivotally attached to the arch-shaped plastic backing strip component of the compressible pad assembly, are fed through the slide-buckles, placed over the wearer's leg, adjusted to a comfortable length, and are clenched by closing the slide-buckle cams.

In a semi-reclining position the tablet support accessory is positioned on the thigh so that the tablet top is near the top of the wearer's knee. This position is ideal for watching movies and TV shows as well as reading e-books and on-line magazines. In the event that the position becomes tiring, for example while watching a long movie, the entire accessory may be lifted off, and shifted to the other leg. Either leg provides a very comfortable viewing angle, almost at eye level.

An aspect of the tablet support accessory is that it facilitates using a tablet, an eReader, and the like while in the reclining or semi-reclining position.

Another aspect of the tablet support accessory is that it can be carried in a small travel bag.

Another aspect of the tablet support accessory is that it is light weight.

Another aspect of the tablet support accessory is that it can be made from inexpensive, materials.

Another aspect of the tablet support accessory is that it is portable.

Another aspect of the tablet support accessory is that it can be made from virtually unbreakable plastics, such as polycarbonate.

Another aspect of the tablet support accessory is that it is very comfortable to use for a long period of time.

Another aspect of the tablet support accessory is that it leaves the user's hands free for other activities.

Another aspect of the tablet support accessory is that it can be used in bed.

Another aspect of the tablet support accessory is that it can be used in a reclining chair with the leg rest in the up position.

Another aspect of the tablet support accessory is that it can be used in a wing chair with an ottoman.

Another aspect of the tablet support accessory is that it can be used when a user is positioned sideways on a sofa with his or her leg up.

Another aspect of the tablet support accessory is that it can be used on a chaise lounge next to a pool or beach.

Another aspect of the tablet support accessory is that it can be used while sitting on the floor with the user's back against the wall.

Another aspect of the tablet support accessory is that it can be used while sitting on the ground with the user's back against a tree.

Another aspect of the tablet support accessory is that it can be used while sitting in a seated legs-crossed position.

Another aspect of the tablet support accessory is that it can be used by physically disabled persons who may lack the use of one or both arms.

Another aspect of the tablet support accessory is that it can be used while seated in bleachers at a game, for example, soccer, baseball, football, etc.

Another aspect of the tablet support accessory is that it can be used while camping, in a tent, around a campfire, etc.

There has been outlined, rather broadly, the features of the present invention in order that the detailed description that follows may be better understood, and in order that the present contribution to the art may be better appreciated. There are additional features of the invention that will be described, and which will form the subject matter of the claims. Additional aspects and advantages of the present invention will be apparent from the following detailed description of an exemplary embodiment with is illustrated in the accompanying drawings. The invention is capable of other embodiments, and of being practiced and carried out in various ways. Also, it is to be understood that the phraseology and terminology employed are for the purpose of description, and should not be regarded as limiting.

BRIEF DESCRIPTION OF THE DRAWINGS

The technology described herein will be better understood by reading the detailed description of the invention with reference to the accompanying drawing figures in which like reference numerals denote similar structure, and refer to like elements throughout, and in which.

DETAILED DESCRIPTION OF THE INVENTION

Figure 1:
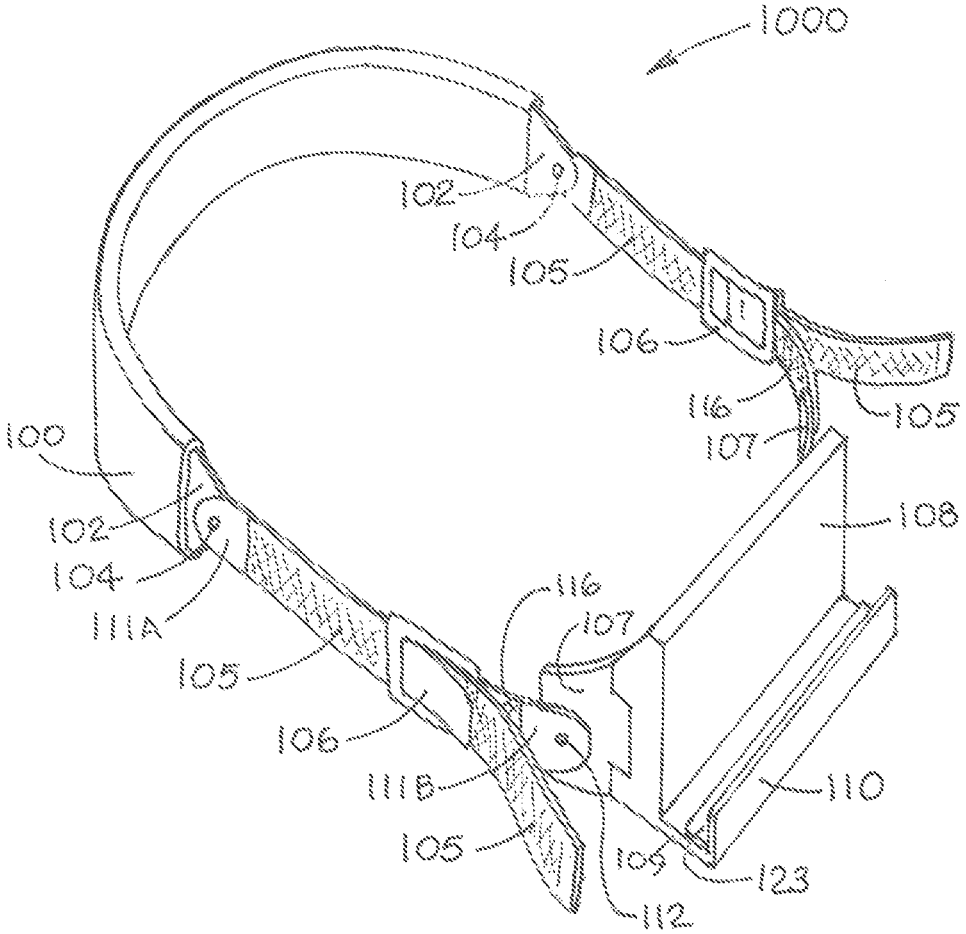
FIG. 1 illustrates a tablet support accessory according to a first embodiment of the technology described herein.
Figure 2:
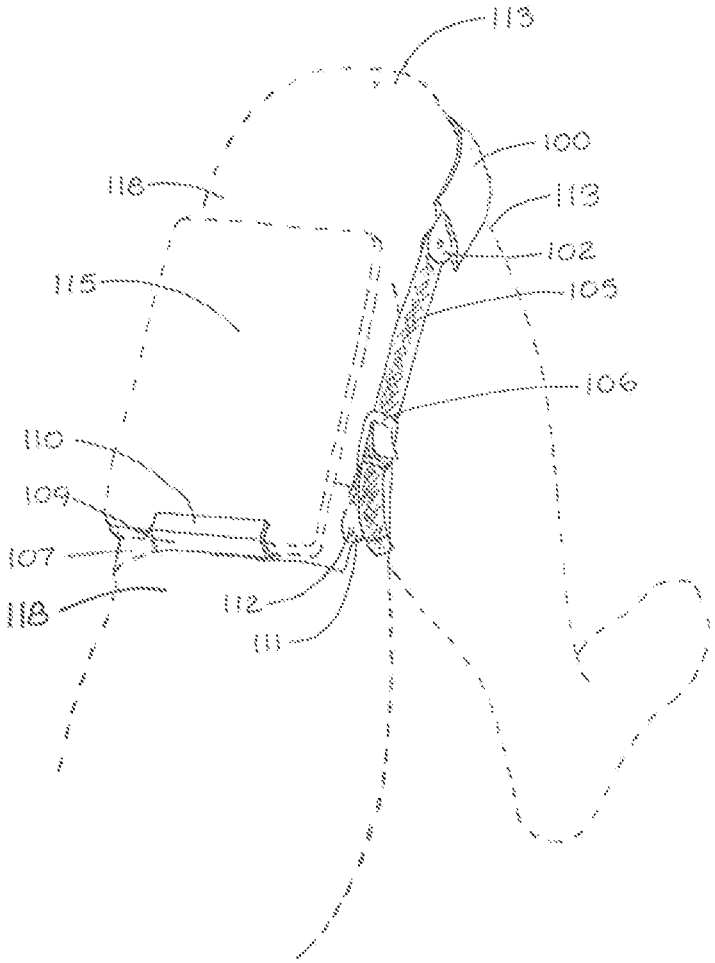
FIG. 2 illustrates the tablet support accessory mounted on a person's leg.
Figure 3:
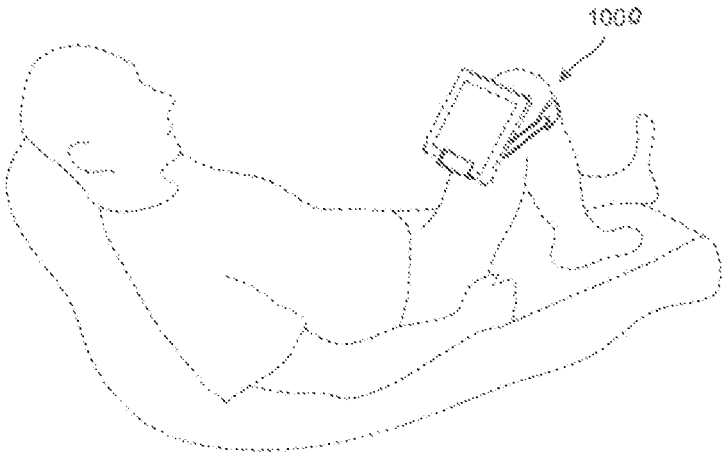
FIG. 3 illustrates the tablet support accessory mounted on a person's leg who is lying in a semi-supine position.
Figure 4:
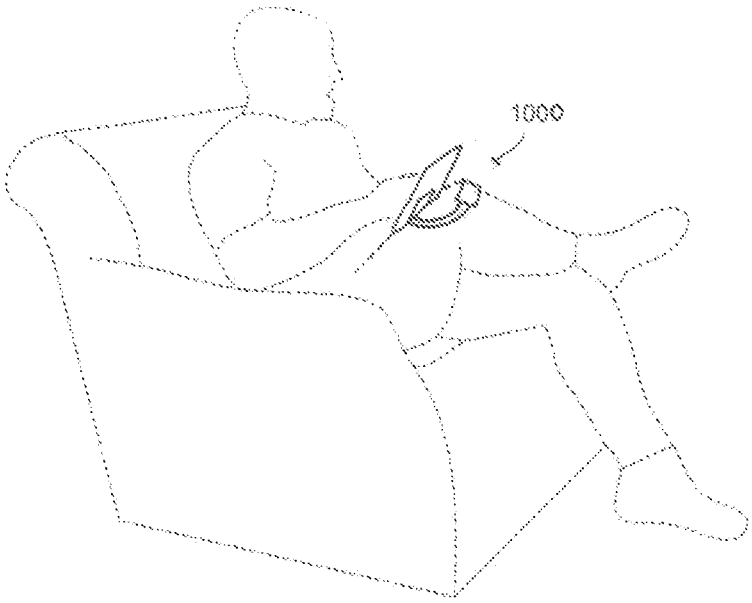
FIG. 4 illustrates the tablet support accessory mounted on a person sitting upright in the cross-legged position.

In describing the first and other embodiments of the technology described herein, as illustrated in FIGS. 1 through 4, specific terminology is employed for the sake of clarity. The invention, however, is not intended to be limited to the specific terminology so selected, and it is to be understood that each specific element includes all technical equivalents that operate in a similar manner to accomplish similar functions.

Referring now to FIGS. 1 through 4, illustrated therein is tablet support accessory 1000. The tablet support accessory 1000 is comprised of a knee-shin support 100 that is configured to hang on the knee-shin region 113 of a person's leg. Knee-shin support 100 is comprised of compressible pad 100-*b*, which is contained within a sleeve comprised of outer cover 100-*a* and outer cover 100-*c*. Outer cover 100-*c* is a non-slip material. An arch-shaped belt 102 is also contained within the sleeve substantially in contact and parallel with pad 100-*b*, and on the side away from the wearer. Tension on the arch-shaped belt 102 acts to compress the pad 100-*b* to comfortably fit against the wearer's knee-shin region 113.

The tablet support accessory 1000 further comprises thigh brace and planar platform combination 120, which, in turn, is comprised of arch-shaped thigh brace 107 and planar platform 108, which are combined as either an assembly, or manufactured as a single piece. iPad 115, or another electronic device, sits on horizontal lip 109, and is prevented from sliding off horizontal lip 109 toward the wearer by tier 123, or by vertical lip 110. Arch-shaped thigh brace 107 is lined with a non-slip material to minimize slipping out of its desired position against the wearer's thigh.

The distal end of flexible strap 105 is attached to pivot tab 111*a*. Pivot tab 111*a* is pivotally attached to the protruding end 102 of arch-shaped belt with eyelet 104, and the proximal end of each flexible strap 105 is slid through slide-buckles 106, and locked in place by the slide-buckle 106's cam-action. Cam-buckle 106 is attached to flexible strap 116 at flexible strap 116's distal end. The terms distal and proximal are with reference to the user, having tablet support accessory 1000 in its usable position. Flexible strap 116 is attached to pivot tab 111*b* at its proximal end, which is pivotally attached to knee brace 107 with eyelet 112.

Using the assembled tablet support accessory 1000 involves the following steps: The wearer installs tablet support accessory 1000, bringing knee-shin support 100 against a comfortable location on his knee-shin region 113. Arch-shaped thigh brace 107 is positioned on the wearer's thigh 118 for the desired viewing position of iPad 115. Flexible straps 105 are adjusted for a slight tension, and locked in place by the cam action of cam-buckles 106. Pivoting action afforded by eyelets 104 and eyelets 112 enable the thigh brace 107 to take a position lower than knee-shin support 100.

Figure 5:
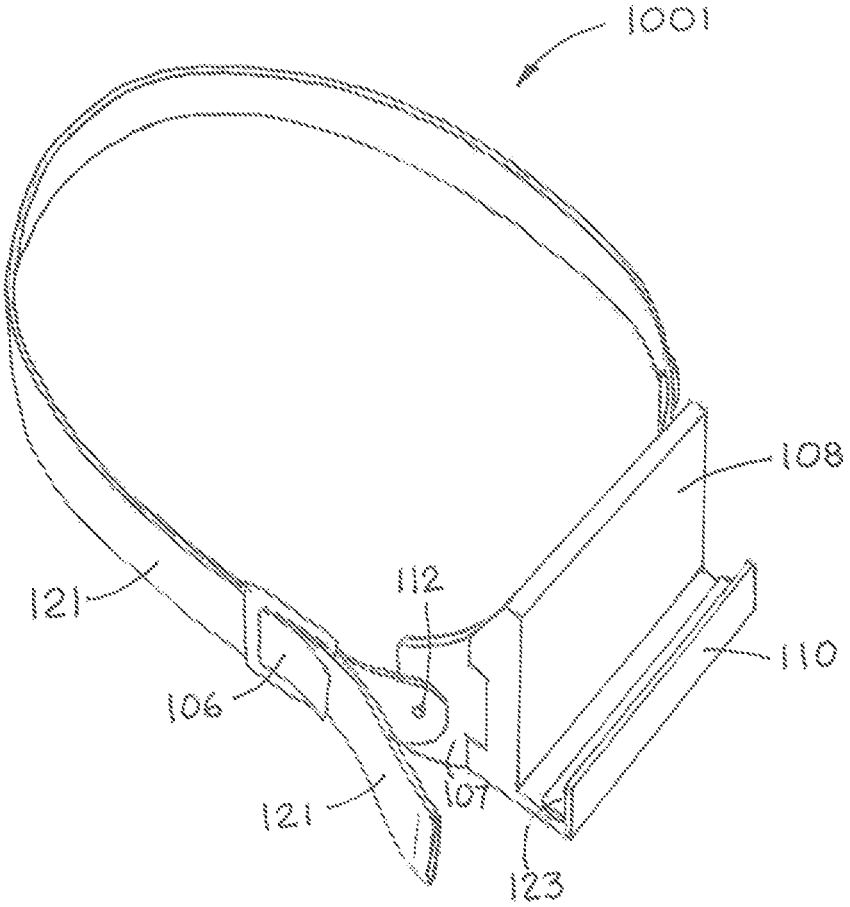
FIG. 5 illustrates the tablet support accessory according to a second embodiment of the technology described herein.

Another embodiment of the tablet support accessory, 1001, as shown in FIG. 5, can be easily understood as having a fixed length flexible strap 121, that employs a single adjustment mechanism, such as cam-buckle 106, which is attached to flexible strap 116, which, in turn, is attached to pivot tab 111*b*. Pivot tab 111*b* is pivotally attached to knee brace 107 by eyelet 112.

Figure 6:
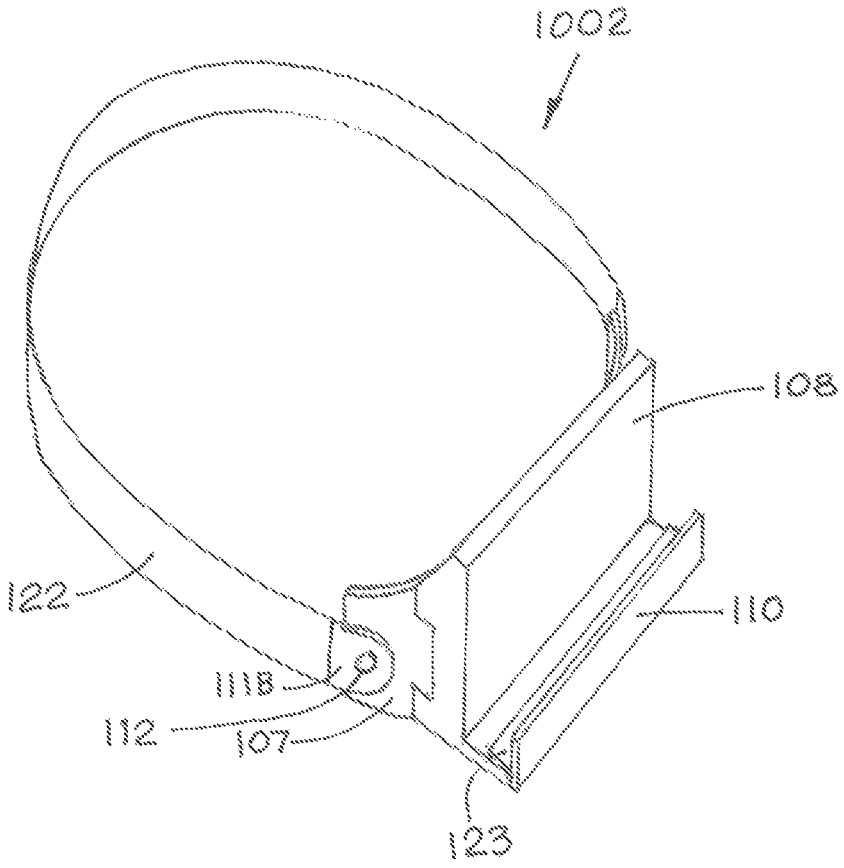
FIG. 6 illustrates the tablet support accessory according to a third embodiment of the technology described herein.
Figure 7:
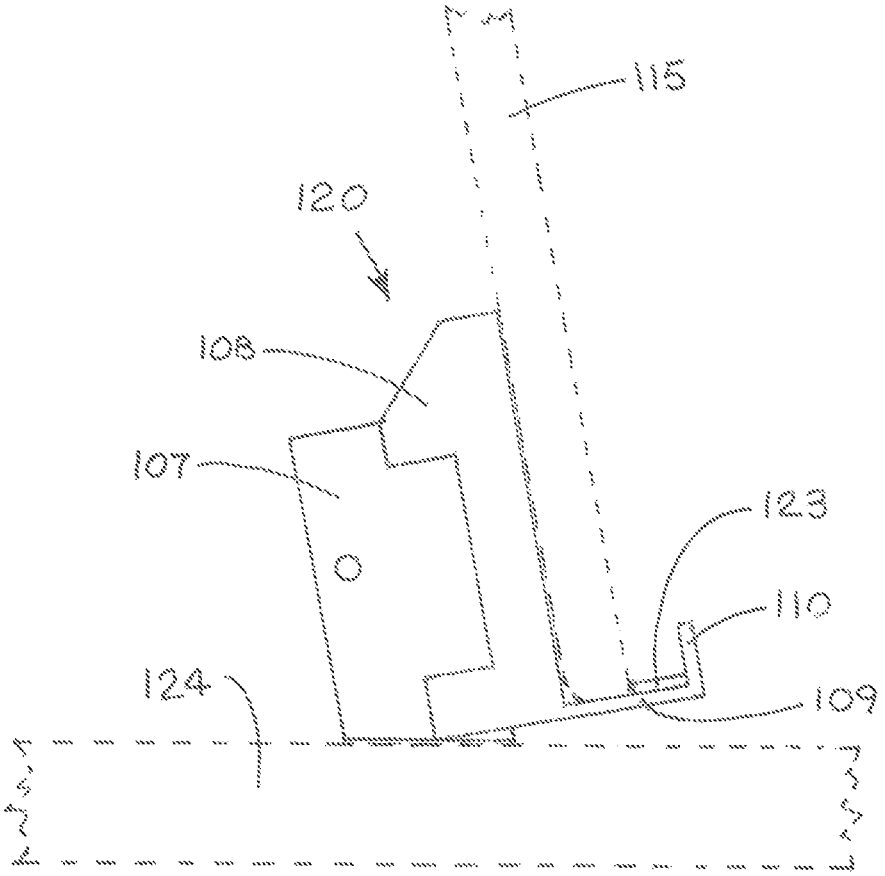
FIG. 7 illustrates a side view of thigh brace and planar platform combination with device in place resting on the first lip, against the tier, and the thigh brace and planar platform combination resting on a desktop.
Figure 8:
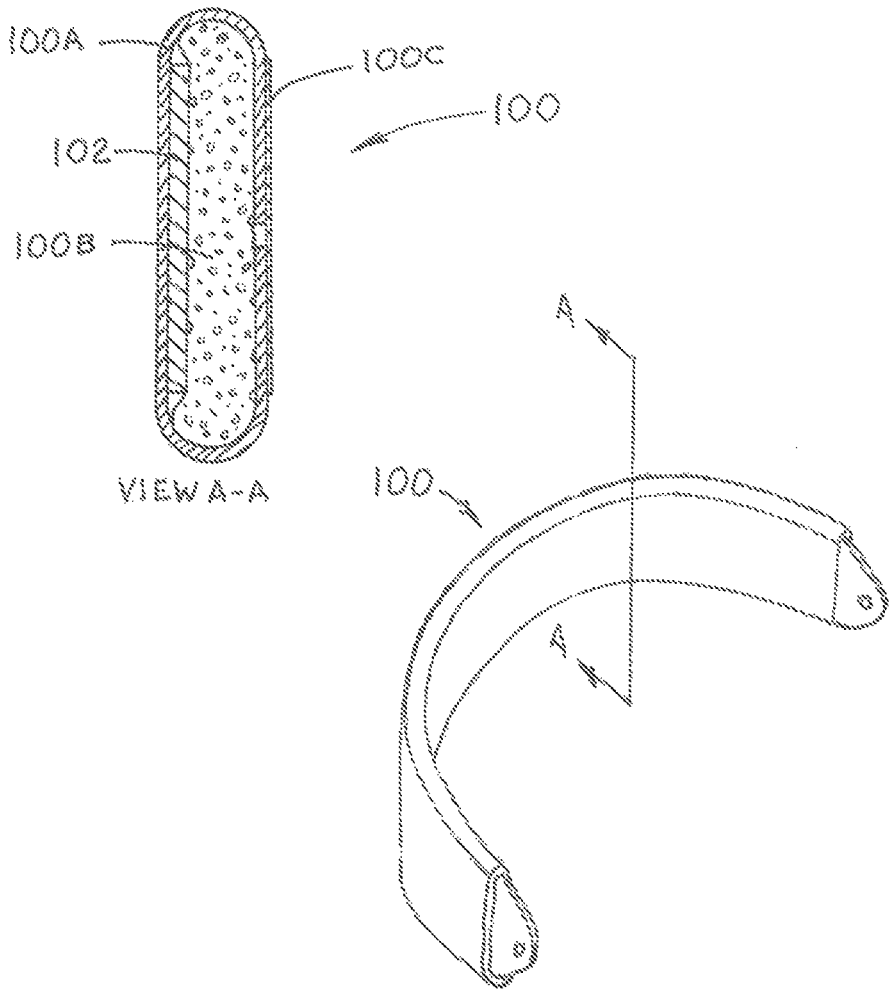
FIG. 8 illustrates the detailed features of the knee-shin support in cross section.

Another embodiment of the tablet support accessory is shown in FIG. 6, labeled 1002. Embodiment 1002 employs a fixed length elastic strap fastened at its ends to pivot tabs 111-*b*, which, in turn, are attached to thigh brace 107 using eyelets 112. However, it can easily be understood that such pivotal connections can be omitted, and pivot tabs 111-*b* may be non-pivotally attached with rivets, glue, staples, and the like.

Although the technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the disclosed technology, and are intended to be covered in the appended claims. The word "iPad" is intended to include other brands of tablets, eReader devices, game players, smart-phones, and computing devices capable of being supported by the technology herein.

We claim:

1. A tablet support accessory for holding any of various devices on a person's thigh, comprising:

a. an arch-shaped thigh brace and planar platform combination on which one of said various devices is held, said thigh brace adapted to rest on a thigh of the user, and said platform including a ledge extending away from a bottom of the planar platform toward said user's chest at substantially 90 degrees to a plane of the planar platform, a longitudinally positioned lip extending upward from an outer edge of the ledge, and at least one longitudinally positioned tier provided on the ledge, whereby said device is prevented from slipping off said ledge by the lip and whereby a lower edge of said device is restricted between the plane of the planar platform and said tier, and a backplane of said device is aligned substantially parallel to, and in contact with, said plane of said planar platform, said various devices comprising an electronic tablet, an iPad, a notepad, a calculator, an electronic game, an eReader, a computer, a GPS, a smart phone, or a printed book;

b. a knee-shin support comprising an arch-shaped belt that is positioned in the knee-shin region of a user's leg;

c. two flexible straps that couple said knee-shin support to said thigh brace and planar platform combination, each flexible strap having a first and second end, the first ends coupled to ends of the knee-shin support and the second ends pivotally coupled to ends of the arch-shaped thigh brace; and, d. at least one means for holding in place said flexible straps after adjusting, selected from a group comprising a cam buckle, a hinged pin buckle, a slide clasp, a male and female insertion buckle, and a hook and loop set, whereby one of said various devices may be supported on said user's raised leg, adjusted for comfort, and viewed and operated interactively by said user in a sitting position, or in a supine or semi-supine position.

2. The tablet support accessory of claim 1, whereby said flexible straps and said thigh brace and planar platform combination self-adjust to the position of said user's leg.

3. The tablet support accessory of claim 1, whereby said flexible straps and said knee-shin support self-adjust to the position of said user's leg.

4. The tablet support accessory of claim 1, wherein said thigh brace and planar platform combination has a predetermined shape that results in an angle of less than 45 degrees between a plane of said planar platform and a vertical reference line when said thigh brace and planar platform combination rests on a horizontal planar surface.

5. The tablet support accessory of claim 1, wherein said thigh brace and planar platform combination is made as single piece by molding of a polymer or elastomer.

6. The tablet support accessory of claim 1, wherein the first ends of the two flexible straps are pivotally coupled to the ends of the knee-shin support.

* * * * *